United States Patent [19]

Tsukasaki

[11] 4,399,781

[45] Aug. 23, 1983

[54] ENGINE PREHEATING CONTROL SYSTEM HAVING AUTOMATIC CONTROL OF GLOW PLUG CURRENT

[75] Inventor: Hidaka Tsukasaki, Kariya, Japan

[73] Assignee: Nippondenso Co., Ltd., Kariya, Japan

[21] Appl. No.: 229,632

[22] Filed: Jan. 29, 1981

[30] Foreign Application Priority Data

Jan. 31, 1980 [JP] Japan ..... 55-11287
Mar. 12, 1980 [JP] Japan ..... 55-31827

[51] Int. Cl.[3] ..... F02P 19/02

[52] U.S. Cl. ..... 123/179 H; 123/145 A; 123/179 BG; 219/497; 219/508; 219/509

[58] Field of Search ..... 123/145 A, 179 B, 179 BG, 123/179 H; 219/492, 497, 507, 508, 509, 510

[56] References Cited

U.S. PATENT DOCUMENTS

| | | | |
|---|---|---|---|
| 4,137,885 | 2/1979 | Ostrom | 123/179 H |
| 4,196,712 | 4/1980 | Kawamura et al. . | |
| 4,258,678 | 3/1981 | Abe | 123/179 H |
| 4,285,307 | 8/1981 | Steinke | 123/179 H |
| 4,322,604 | 3/1982 | Kawamura et al. | 123/179 H |

FOREIGN PATENT DOCUMENTS

| | | | |
|---|---|---|---|
| 54-47040 | 4/1979 | Japan | 123/179 H |
| 54-117836 | 9/1979 | Japan | 123/179 H |
| 55-123373 | 9/1980 | Japan | 123/145 A |
| 1299589 | 12/1972 | United Kingdom | 123/179 H |
| 2031516 | 4/1980 | United Kingdom | 123/179 B |

*Primary Examiner*—Parshotam S. Lall

*Attorney, Agent, or Firm*—Cushman, Darby & Cushman

[57] ABSTRACT

In an engine preheating control system, in which the temperature of glow plugs mounted in a diesel engine is held in a constant high temperature range during the cranking operation after the closure of an engine key switch through the control of power supply to the glow plugs based upon the detection of changes of the resistance of the glow plugs, a main relay for controlling the power supply from a power supply source through a current detecting resistor to the glow plugs and a sub-relay for controlling power supply through a stable preheating resistor and the detecting resistor to the glow plugs are energized and de-energized in response to first to fourth control signals. The first control signal is produced from a comparator comparing the voltage drop across the detecting resistor and a reference voltage, the second control signal is produced from a start sensitive means, the third signal represents a predetermined period of time depending upon the engine cooling water temperature and is produced through a cooling water temperature detector and a timer circuit, and the fourth signal is produced through the detector and a voltage comparator circuit through the comparison of the detected cooling water temperature and a preset temperature. After the closure of the engine key switch, a fifth control signal representing a predetermined time period depending upon the cooling water temperature is produced through the voltage comparator circuit and a timer circuit, and a display lamp is on-off controlled according to the fifth control signal.

13 Claims, 4 Drawing Figures

ENGINE PREHEATING CONTROL SYSTEM HAVING AUTOMATIC CONTROL OF GLOW PLUG CURRENT

This invention relates to engine preheating control systems for diesel engines provided with glow plugs and, more particularly, to an engine preheating control system, in which the temperature of the glow plugs which have a positive resistance-temperature characteristic is controlled to be within a predetermined range through the control of current supply to the glow plugs in accordance with the detection of changes of current through the glow plugs.

In the usual diesel engine or rotary engine, glow plugs are provided as preheating means for facilitating the start of the engine. The glow plugs are energized for preheating for several to several tens of seconds before the start of the engine so that reliable ignition and smooth start of the engine can be obtained subsequently with the rotation of the starter.

An object of the invention is to provide an engine preheating control system, which permits automatic control of the current supply to the glow plugs and also permits extreme reduction of the rising period of preheating to maintain the glow plug temperature at a sufficiently high value independent of changes, particularly reduction, of the source voltage with a simple circuit construction.

Another object of the invention is to permit, in addition to the automatic control of current supply to the glow plugs and extreme reduction of the rising period of preheating, appropriate heating of the glow plugs during the cranking operation and after the start of the engine as well, thereby preventing the delay of ignition that might otherwise result due to a low combustion chamber temperature after start and also preventing increase of the combustion source vibrations and generation of harmful components in the exhaust gas.

The elimination of the above inconveniences is one of the most important problems in case where it is intended to quickly heat the glow plugs and detect the high temperature state thereof from the current therethrough as according to the invention, because there is no means for accurately detecting the engine combustion temperature.

A further object of the invention is to provide a control system, which is provided with a means for detecting the engine temperature and the start of the engine and can solve the afore-mentioned problems through the control of the heat generation from the glow plugs in accordance with a detection signal from the detecting means.

A still further object of the invention is to provide a control system, with which the number of switching operations of a switching means for switching the state of current supply to the glow plugs can be reduced to improve the durabilty of switching elements constituting the switching means.

According to the invention, there is provided an engine preheating control system comprising: engine preheating glow plugs each comprised of a heat generator having a predetermined temperature coefficient of resistance; a stable preheating resistor for reducing the voltage applied to said glow plugs; a power supply; a current supply path switching means including a first current supply path for supplying current from said power supply to said glow plugs without the agency of said stable preheating resistor and a second current supply path for supplying current from said power supply through said stable preheating resistor to said glow plugs, said first and second current supply paths being switched one over to the other; a current detecting means for producing a current detection signal proportional to the current flowing said glow plugs; and a control means for controlling said current supply path switching means to switch said first and second current supply paths in response to said current detection signal.

According to the invention, for the glow plugs are used heat radiators which have a constant positive resistance-temperature characteristic and, desirably, are capable of reaching a saturation temperature with about one half the rated voltage. With these glow plugs, the inrush current can be increased, and the goal temperature, for instance 900° C., can be reached in about 3 seconds. Also, the current supply is controlled in accordance with the result of comparison of the resistance of the glow plugs detected from the current therethrough and a reference resistance in a voltage comparator such that after the reaching of 900° C. a switching relay is opened to insert a stable preheating circuit for slowly lowering the glow plug temperature and that when the temperature is lowered the switching relay is closed again in response to the lower limit of the comparator hysteresis for quickly elevating the glow plug temperature again. In this way, quick heating and stable preheating are alternately repeated within a predetermined temperature range.

Further, a main relay, which is on-off operated in accordance with the changes of the resistance of the glow plugs mounted in the diesel engine or the like and having a positive resistance-temperature characteristic and permits direct supply of current from a power supply to the glow plugs when it is "on" so as to maintain the glow plug temperature within a predetermined high temperature range, and a sub-relay which is normally held "on" to permit supply of current from the power supply through a stable preheating resistor to the glow plugs and is turned off according to the engine cooling water temperature or a timer output, are provided, and after the start of the engine the glow plugs are held at a high temperature only in a current supply state provided by the sub-relay.

The invention will now be described in conjunction with some preferred embodiments thereof with reference to the accompanying drawings. In the drawings, like parts are designated by like reference numerals, and in which.

Figure 1:
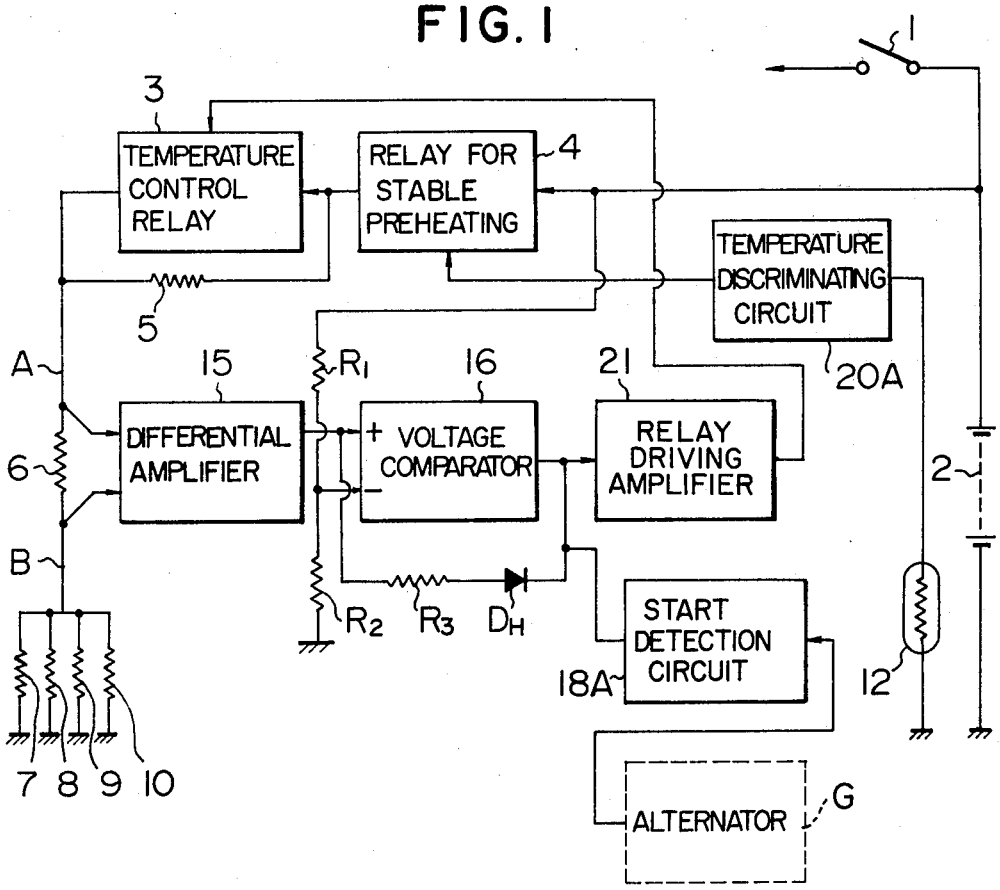
FIG. 1 is a schematic block diagram showing an embodiment of the invention.

Referring now to FIG. 1 showing an embodiment of the invention, designated at 1 is a key switch, at 2 a battery, at 3 a temperature control relay, 4 a relay for stable preheating, at 5 a resistor for stable preheating, at 6 a current detection resistor having a very small temperature coefficient of resistor and offering a very small resistance, at 7, 8, 9 and 10 glow plugs composed of heat radiators having positive temperature coefficients of resistance, at 15 a differential amplifier, $R_1$ and $R_2$ resistors for voltage division, at 16 a voltage comparator, at $R_3$ and $D_H$ respectively a resistor and a diode for providing a hysteresis in the operation of the voltage comparator, at 21 an amplifier for driving the relay, at 12 an engine cooling water temperature detection thermistor, at 20A a temperature discriminating circuit for producing a discrimination signal when the temperature detected by the thermistor exceeds a predetermined value, at 18A a start detection circuit, and at G an alternator for producing a start signal.

Figure 2:
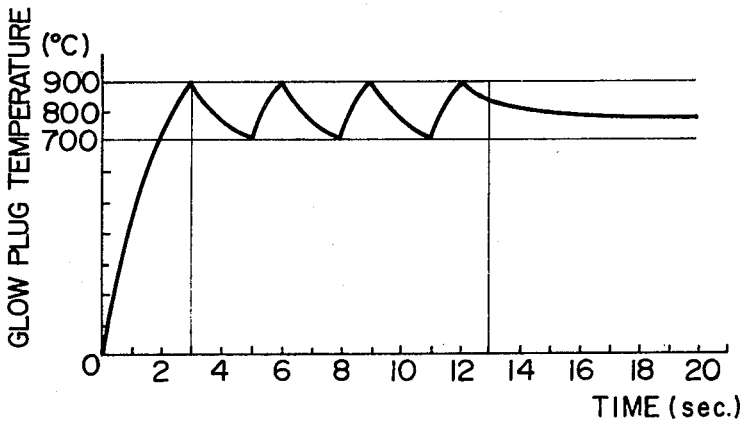
FIG. 2 is a graph showing the glow plug temperature for illustrating the operation of the system shown in FIG. 1.
Figure 3:
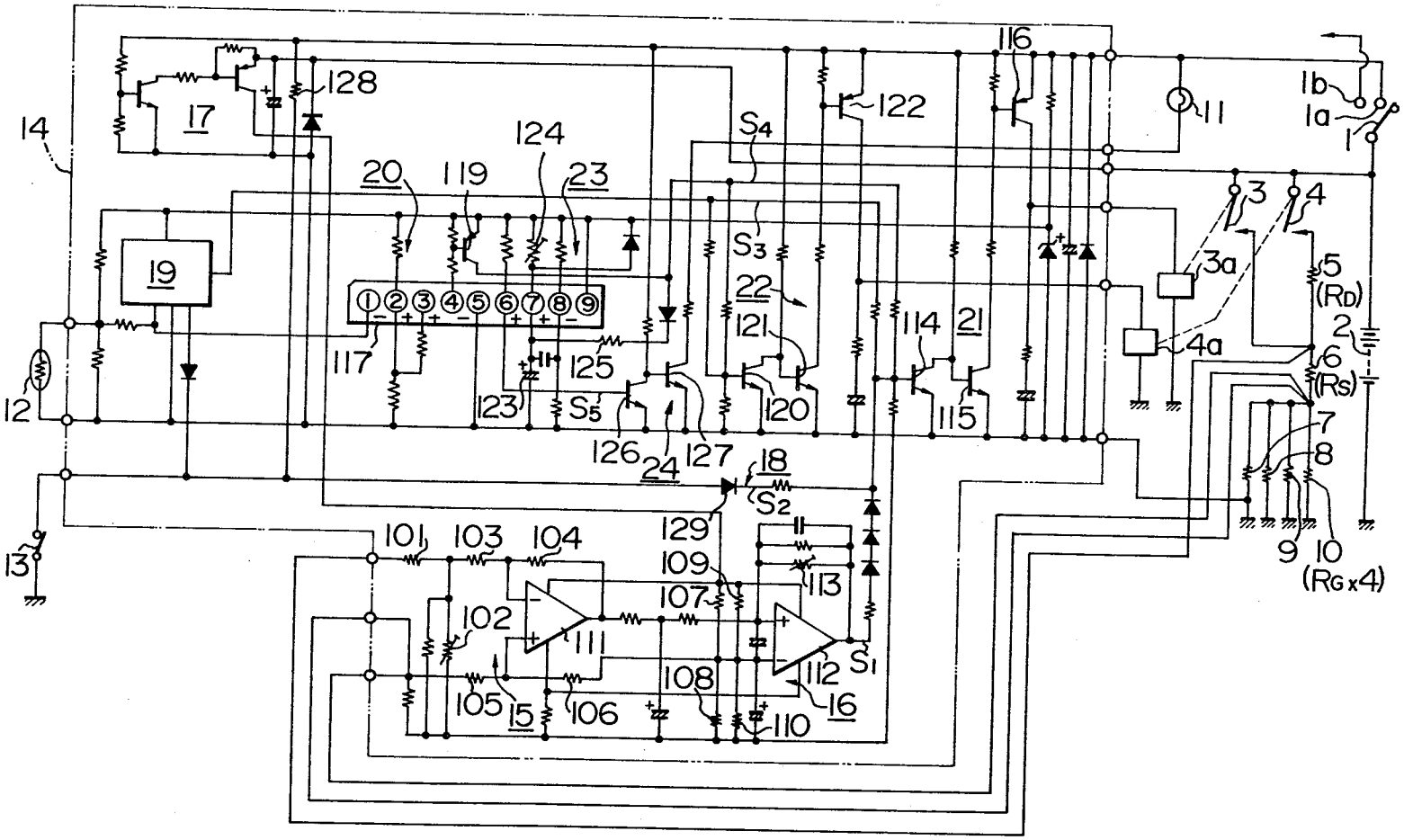
FIG. 3 is a circuit diagram showing a second embodiment of the invention.

Now, the operation will be described. When the key switch 1 is closed, the apparatus is rendered operative with the power source coupled to the differential amplifier 15, comparator 16, amplifier 21 and detection circuit 12. When the temperature of the glow plugs 7 to 10 is low, the output signal of the comparator 16 is at a "1" level, and also when the engine cooling water temperature detected by the thermistor becomes lower than 40° C., the temperature control relay 3 and stable preheating relay 4 are energized to cause current from the power source through the relays 3 and 4 and current detection resistor 6 to the glow plugs 7 to 10, thus quickly causing heat generation in a first current path. In this case, there holds a relation $$\frac{V_B}{V_A} = \frac{R_G/4}{R_G/4 + R_S}$$

where $R_G$ is the resistance per glow plug, $R_S$ is the resistance of the current detection resistors 6, $V_A$ is the potential on the end of the current detection resistor 6 on the side of the power source (point A) with reference to the ground potential, and $V_B$ is the potential on the juncture between the current detection resistor 6 and glow plugs 7 to 10 (point B). The resistance when the goal temperature of the glow plugs is 900° C., is determined by the temperature coefficient of resistance of the heat generator, by setting the resistances of the voltage division resistors $R_1$ and $R_2$ such as to meet the ratio in the above equation, the output of the comparator 16 is inverted to a "0" level to open the temperature control relay 3 since the resistance $R_S$ of the current detection resistor 6 is constant. As a result, the glow plugs 7 to 10 are energized through the stable preheating resistor 5 and stable preheating relay 4 (constituting a second current path). The resistance of the stable preheating resistor 5 is set such that the temperature of the glow plugs 7 to 10 is saturated at about 900° C. when the source voltage is maximum, and thus the glow plug temperature is reduced in the usual working range. By the action of the hysteresis circuit constituted by the resistor $R_3$ and diode $D_H$ provided for the comparator 16, the output of the comparator 16 is inverted again to the "1" level to close the temperature control relay 3. As a result, the temperature of the glow plugs is increased. The temperature range of the glow plugs 7 to 10 is determined by the operating point of the comparator 16. If the hysteresis circuit comprising the resistor $R_3$ and diode $D_H$ is set such that the output of the comparator 16 is inverted when the glow plug temperature becomes 700° C., a control characteristic as shown in FIG. 2 is obtained. Thus, when the glow plug temperature is changed with a change of the source voltage due to such cause as cranking, it is detected and controlled as the terminal voltage across the current detection resistor 6, so that it can be reliably held at a high temperature.

After the engine is started with the closure of a starter switch (not shown) of the key switch 1, when the output of the start detection circuit 18A is inverted to "0" level in response to the rising of the middle contact voltage in the alternator G, the temperature control relay 3 is opened, and the glow plugs are energized through the stable preheating resistor 5. When the engine cooling water temperature is increased to 40° C., the stable preheating relay 4 is opened by the temperature detection circuit 12. When the cooling water temperature is already above 40° C. at the time of the closure of the key switch 1, the relay 4 is also opened so that the glow plugs are not energized.

The above embodiment of the invention is by no means limitative, and various changes and modifications can be made.

For example, the starter may be automatically rendered operative when the first "1" level output signal is produced from the comparator 16. Also, a lamp may be arranged to be turned on or off to instruct the driver to operate the starter. Further, in place of detecting the engine cooling water temperature for stopping the stable preheating after the start of the engine, the stable preheating relay 4 may be opened according to the output of a timer circuit which produces a signal a predetermined period time after the closure of the key switch or after the detection of the start.

Further, it is possible to connect the stable preheating relay 4 in series with the stable preheating resistor 5 and also in parallel with the temperature control relay 4. By so doing, the switch capacity of the stable preheating relay 4 can be reduced. Also, the operation of the temperature control relay 3 is not spoiled even at the open-circuit trouble of the stable preheating relay 4, so that even in this case the glow plug 7 can be elevated to a certain temperature through heat generation. Further, in this arrangement, the output signal of the temperature detection circuit 12 may be coupled to the amplifier 21.

According to the invention, the following effects can be obtained.

(1) Since the energization through the stable preheating resistor and the energization with this resistor substantially short-circuited are switched over to each other, the number of switching elements of the switching means, for instance the number of operations of relay, can be increased to improve the durability.

(2) Since the temperature of the glow plugs is detected through the detection of the resistance thereof and two operating points with respect to the temperature are determined by the voltage comparator, it is possible to stably maintain the glow plug temperature in the goal temperature range. Particularly, it is possible to steadily maintain the glow plug temperature irrespective of variations of the source voltage at the time of the cranking.

(3) The temperature control property is superior, so that it is possible to use glow plugs of low rated voltage. Thus, the glow plugs can be quickly heated to the goal temperature, and the engine starting period can be extremely reduced.

(4) The circuit construction is simple and inexpensive.

Now a second embodiment will be described. Designated at 1 is an engine key switch having an ignition contact 1*a* and a starter contact 1*b*. Designated at 2 a power supply battery mounted in the vehicle, at 3 and 4 relay switches, and 3a and 4a relay coils thereof. Designated at 5 is a stable preheating resistor connected in series with the relay switch 4. Designated at 6 is a detecting resistor, which offers a very small resistance and across which a voltage drop proportional to the current through it is produced. Designated at 7, 8, 9 and 10 are glow plugs comprising heat radiators having a practically constant positive temperature coefficient of resistor and mounted in an auxiliary combustion chamber of the diesel engine. When the relay coil 3a is energized, the relay switch 3 is closed, and the glow plugs 7 to 10 are directly energized from the power supply 2 through the detecting resistor 6. This state of energization is referred to as first energization state. When the relay coil 4a alone is energized without the relay coil 3a energized, only the relay switch 4 is closed to supply current to the glow plugs 7 to 10 through the stable preheating resistor 5 and detecting resistor 6. This state of energization is referred to as second energization state. The first energization state is brought about irrespective of whether there is the second energization state.

Designated at 11 is a lamp for indicating that the cranking can be started, at 12 a temperature detector comprising a thermistor mounted in an engine cooling water jacket, at 13 a start detection switch of a well-known construction adapted to be opened when the neutral voltage of a three-phase AC generator for charging the power supply mounted on the vehicle is raised to a predetermined level.

Designated at 14 is a control circuit which includes the following circuits. Designated at 15 is a differential amplifier circuit for amplifying the voltage drop across the detecting resistor 6, and at 16 a voltage comparator circuit for comparing the amplified voltage and a reference voltage. These circuits 15 and 16 are furnished with power from a circuit 17 which compensates for the lead voltage drop produced due to large glow plug current flowing through the relay switches 3 and 4. Through these circuits, a control signal $S_1$, which is at a low level when the voltage drop across the detecting resistor 6 is higher than a predetermined upper limit value determined by a reference voltage and the hysteresis in the voltage comparison circuit 16 and is at a high level when the voltage drop is lower than a predetermined lower limit value.

Designated at 18 is a start response circuit, which produces a control signal $S_2$ which is inverted to a high level when the start detection switch 13 is opened with the start of the engine and is at a low level (i.e., open level) while the start detection switch 13 remains closed before the start.

Designated at 19 is a timer circuit including a time constant circuit and a voltage comparison circuit. It produces a control signal $S_2$ which is at a low level until a predetermined period determined by the resistance of the temperature detector 12 (i.e., thermistor) from the instant of closure of the start detection switch 13 and is inverted to a high level when this period is elapsed. The timer period until the inversion of the control signal from the low level to the high level is the shorter the lower the resistance of the temperature detector 12 (i.e., the higher the temperature).

Designated at 20 is a voltage comparator circuit, and it includes a comparator in a comparator element 117 which is a semiconductor integrated circuit. It produces a control signal $S_4$ which is at a low level when the resistance of the temperature detector 12 (i.e., thermistor) is lower than a value corresponding to a preset temperature, for instance 40° C., and is inverted to a low level (i.e., open level) when the resistance becomes lower than this value.

Designated at 21 and 22 are power amplifier circuits each including several transistors. The control signals $S_1$ to $S_4$ mentioned above are coupled to the first stage transistors of these amplifier circuits, and the last stage transistors thereof are adapted to energize the respective relay coils 3a and 4a.

Designated at 23 is a timer circuit including another comparator in the semiconductor integrated circuit comparator element 117. After the closure of the key switch 1 (i.e., the ignition contact 1a), it produces a control signal $S_5$ which is helt at a low level for several-hundred milliseconds when the resistance of the temperature detector 12 is corresponding to a temperature higher than 40° C. while it is held at the low level for several seconds when the resistance is higher. Designated at 24 is a power amplifier circuit for power amplifying the control signal $S_5$ to thereby on-off control the display lamp 11.

Further details of this circuit construction will now be described in connection with the operation thereof. In case when the engine is not sufficiently warmed up and the cooling water temperature is below 40° C., by closing the ignition switch 1a of the key switch 1 the comparator 112 produces as its output the control signal $S_1$ at the low level since the output voltage of the differential amplifier 111 in the differential amplifier circuit 15 is lower than the input voltage coupled from the voltage divider comprising the resistors 109 and 110 to the comparator 112 in the voltage comparator circuit 16. Also, before the start of the engine, the control singals $S_2$ and $S_3$ are at the low level. Further, since the cooling water temperature is lower than 40° C., the input voltage coupled to the input terminal 1 of the comparator element 117 is higher than the reference voltage coupled to the input terminal 2. In this case, the transistor 119 is off, and the control signal $S_4$ is at the low level. Thus, in the amplifier circuit 21 the transistor 114 is off while the transistors 115 and 116 are turned on to energize the relay coil 3a, thus closing the relay switch 3 to realize the first energization state. Since the control signals $S_3$ and $S_4$ are at low levels at this time, in the amplifier circuit 22 the transistor 120 is off while the transistors 121 and 122 are turned on to energize the coil relay 4a and close the relay switch 4. However, all the current supplied to the glow plugs 7 to 10 flows through the relay switch 3, so that practically only the first energization state is effective.

With the large current, the glow plugs 7 to 10 are quickly heated, and their resistance is thus increased to reduce the current through the detecting resistor 6. Denoting the resistance of the detecting resistor by $R_S$, the resistance of each of the glow plugs 7 to 10 by $R_G$ and the resistances of the resistors 101, 102, 103 and 104 in the differential amplifier circuit 15 respectively by $R_{101}$, $R_{102}$, $R_{103}$ and $R_{104}$, with the increase of the glow plug temperature beyond the balance point of the bridge given as $$\frac{R_S}{R_G/4} = \frac{R_{101}}{R_{102}} \; (R_S, R_G < 1\ \Omega)$$

the resistance $R_G$ is increased, the output of the differential amplifier 111 is amplified according to the ratio $R_{104}/R_{103}$ of the resistances $R_{103}$ and $R_{104}$ of the resistors 103 and 104, and the amplified output is coupled to the comparator circuit 16 for comparison with the reference voltage coupled from the voltage divider consisting of the resistors 109 and 110. When the reference voltage is reached, the output of the comparator 112, i.e., the control signal $S_1$, is inverted to the high level, while at the same time hysteresis is given by the feedback resistor 113. However, with the inversion of one of the control signals to the high level the transistor 114 is turned on while the following stage transistor 115 is turned off, so that the main relay 3 is opened.

With the opening of the main relay 3, current is caused to flow through the stable preheating resistor 5 and detecting resistor 6 into the glow plugs 7 to 10 with a low voltage (which is the second energization state), so that the temperature of the glow plugs 7 to 10 is reduced. As a result, the resistance $R_G$ of the glow plugs is reduced to reduce the output level of the differential amplifier 111. When a preset hysteresis point of the comparator 112 is reached, the output of the comparator 112 is inverted to the low level, whereupon the main relay 3 is energized again. The above sequence of temperature control is reduced, whereby the glow plug temperature is controlled to be within a range between 900° C. as the upper limit and 700° C. as the lower limit. This temperature control is continued from the closure of the key switch 1 till the end of the cranking.

Since the control signal $S_4$ is at the low level (i.e., open level) after the closure of the key switch 1 as mentioned earlier, in the timer circuit 23 a timer capacitor 123 is charged through a resistor 124. Immediately after the closure of the switch 1, the control signal $S_5$ is at the low level, and the input voltage coupled to (the input terminal 7 of) the comparator (comparing element 117) is gradually increased. Thus, transistors 126 and 127 are respectively held "off" and "on" to hold the display lamp 11 "on" for about 3.5 seconds. This period is set to coincide with the period, during which the glow plugs 7 to 10 are heated to the temperature range of 700° to 900° C. through the aforementioned temperature control. When the elapsed time display lamp 11 is turned off, this means that the glow plugs are heated to a sufficient extent for cranking.

When the key switch 1 is switched to the starter contact **1*b* by the driver, a starter motor (not shown) is energized to start the cranking. During this cranking, the glow plugs are held at a high temperature for assisting the engine start. When the engine is started so that the neutral voltage of the three-phase generator rises, the start detection switch 13 is opened. This enables the start response circuit 18, that is, a diode 129 is forwardly biased through the resistor 128, thus causing the inversion of the control signal $S_2$ to the high level. As a result, the transistor 114 is turned on independently of the other control signals $S_1$, $S_3$ and $S_4$, thus turning off the transistors 115 and 116 to deenergize the relay coil 3*a*. In other words, when the engine is started, the relay coil 3*a* is deenergized to open the relay switch 3, whereby the glow plugs 7 to 10 are energized through the stable preheating resistor 5**.

This second energization state is continued until the control signal $S_3$ or $S_4$ is inverted to the high level. More particularly, with the opening of the detection switch 13 caused with the start of the engine, after the lapse of a predetermined period determined by the engine cooling water temperature the control signal $S_3$ is inverted to the high level to turn on the transistor 120 and turn off the transistors 121 and 122, thus de-energizing the relay coil **4*a*. In this way, the glow plugs are energized through the stable preheating resistor 5** for several ten seconds according to the cooling water temperature after the start of the engine.

When the engine has been warmed up to a temperature above a predetermined temperature so that the engine cooling water temperature is increased up to 40° C. after the engine start in a shorter period of time than the period determined by the timer circuit 19, the output of the inversion output terminal 4 of one of the comparators (in the comparing element 117) in the voltage comparator circuit 20 is inverted to the low level to turn on the transistor 119, thus causing the inversion of the control signal $S_4$ to the high level. As a result, the transistor 120 is turned on and the transistors 121 and 122 are turned off, thus de-energizing the relay coil **4*a* to cut current to all the glow plugs 7 to 10**.

In this embodiment, the final goal of the control of the engine cooling water temperature is set to 40° C., and when this temperature is reached the temperature of the combustion chamber is such that sufficiently high and steady combustion can be expected.

When the engine cooling water temperature is already 40° C. before the start of the engine, the comparator (in the comparing element 117) produces a low level output from the output terminal 4 to turn on the transistor 119. Thus, the control signal $S_4$ is inverted to the high level to turn on the first stage transistors 114 and 120 in the amplifier circuits 21 and 22. Thus, both the relay coils **3*a* and 4*a* remain "off", so that the glow plugs 7 to 10 are not energized at all. In this case, since the capacitor 123 in the timer circuit 23 is quickly charged through the resistors 124 and 125 with the closure of the key switch 1, the output signal from the output terminal 6 is held at the low level for a period of several hundred milliseconds (about 0.5 second), and the display lamp 11 is held on during this short period of time. Thus, the driver is informed of the fact that the cranking can be started immediately after the switching of the key switch 1 to the contact 1*a***.

Figure 4:
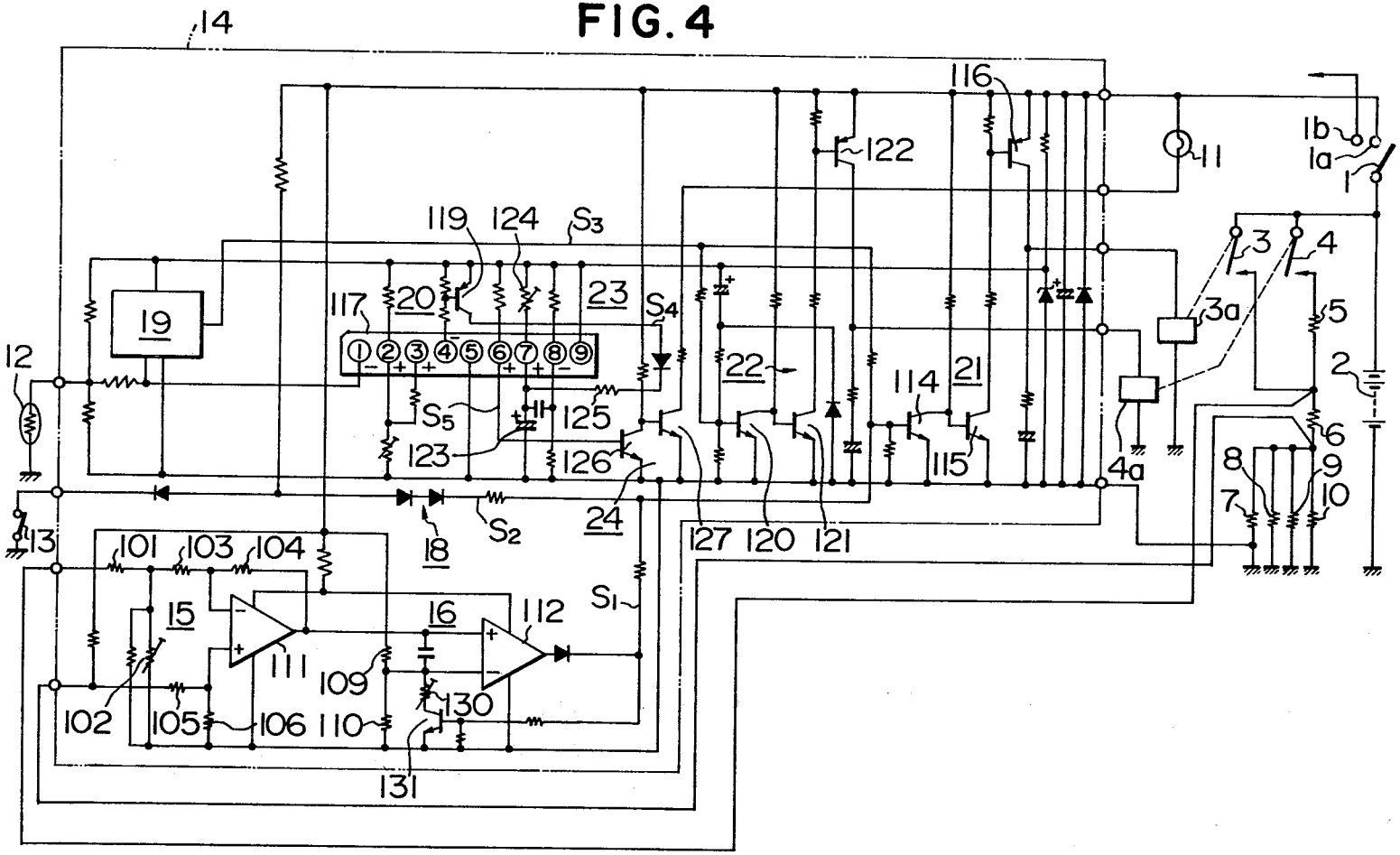
FIG. 4 is a circuit diagram showing a third embodiment of the invention.

Now, a third embodiment of the invention will be described with reference to FIG. 4. The main difference of this embodiment from the preceding second embodiment will be described. In this embodiment, an operational amplifier circuit 15 and a voltage comparison circuit 16 are connected such that they are directly supplied with power from the ignition contact **1*a* of the key switch 1. In this embodiment, the voltage drop across the lower supply line through which the glow plugs 7 to 10 are energized from the relay switches 3 and 4, has a negligible value. In the voltage comparator circuit 16, a switching transistor 131 on-off operated according to the output signal of a comparator 112 is provided for providing a hysteresis to the reference voltage determined by resistors 109, 110 and 130**.

The timer circuit 19 in this embodiment is constructed to be activated for timer operation from the instant of the switching of the key switch 1 to the ignition contact **1*a***, but its basic role is the same as that in the second embodiment.

The voltage comparator circuit 20 is constructed such that it supplies the control signal $S_4$ which indicates whether the engine cooling water temperature is about 40° C. to the timer circuit 23 only and not to the amplifier circuits 21 and 22. More particularly, in this embodiment even if the engine cooling water temperature is above 40° C. the glow plugs 7 to 10 are energized in the second energization state only for several to several ten seconds under the control of the output signal of the timer circuit 19. Thus, even when the engine cooling water temperature is above '° C. in case of resuming the engine operation after a while, the glow plugs are heated, so that the ignition property and starting property are improved.

In addition to the above embodiments, another modification may be made in such a manner that the reference voltage supplied by the resistors 109 and 110 may be alternatively changed to the voltage comparator circuit 16 in response to the output signal of the thermistor 12 or that the resistors 109 and 110 are fed from the input terminal portion of the differential amplifier circuit 15 in order to avoid the change of the temperature control point which may be caused due to the long length of wire harness starting from the detecting resistor 6 via the differential amplifier circuit 15 to the voltage comparator circuit 16.

As has been described in the foregoing, according to the invention with an arrangement that the state of energization of the glow plugs through the stable preheating resistor and the energization state with this stable preheating resistor substantially in the short-circuit is switched in accordance with the detection of the temperature of the glow plugs from the resistance thereof until the engine start is completed, it is possible to steadily maintain the glow plug temperature between the upper and lower limits of the goal temperature range with a reduced number of switching element operations. Besides, quick rising of temperature can be obtained with glow plugs of a low voltage rating. Further, after the start of the engine the period of energization through the stable preheating resistor is determined according to the engine temperature, and thus it is possible to prevent various inconveniences that may otherwise result from a low temperature of the combustion chamber after the start.

What is claimed is:

1. An engine preheating control system for preheating of an engine before starting of a starter motor, said system comprising:

a switch for initiating the preheating of the engine;

engine preheating glow plugs each including a heat generator having a predetermined temperature coefficient of resistance;

a stable preheating resistor for reducing the current applied to said glow plugs;

a power supply;

switching means including relays for controlling supply of current to said plugs and defining a first path for supplying current from said power supply to said glow plugs without the agency of said stable preheating resistor and a second path for supplying current from said power supply through said stable preheating resistor to said glow plugs, said first and second current supply paths being switched over from one to the other;

current detecting means for producing a current detection signal proportional to the current flowing through said glow plugs; and control means for controlling said current supply path switching means to selectively switch said first and second current supply paths in response to said current detection signal in order to supply current to said glow plugs through said first path to raise the temperature of said plugs up to a first predetermined value, thereafter to supply current to said glow plugs through said second path wherein said stable preheating resistor defines the supplied current to gradually lower the temperature of said plugs from the first predetermined value to a second predetermined value and thereafter to supply current to said glow plugs again through said first path, the selective switching of said first and second paths being initiated by said switch being actuated before starting of the engine.

2. A system according to claim 1, wherein said current detecting means comprises:

a detecting resistor contained in said first and second current supply paths, said detecting resistor having a very small temperature coefficient of resistance and offering a very small resistance to the current supplied to said glow plugs;

and said control means includes:

a differential amplifier for amplifying a voltage drop across said detecting resistor to produce an amplified output, a comparator for comparing the amplified output and a first preset voltage to produce an output signal at one level when the former is higher than the latter and at another level when the former is lower than the latter, and means for controlling the switching of said switching means according to the output signal of said comparator.

3. An engine preheating control system according to claim 2 which further comprises a hysteresis circuit for giving a hysteresis characteristic to the preset voltage of said comparator circuit.

4. An engine preheating control system according to claim 1 or 2, wherein said glow plugs reach a saturation temperature when energized with a voltage lower than about one half of the rated voltage of the power supply, and also wherein said stable preheating resister is set such that saturation of said glow plugs results at a temperature of 900° C. when said glow plugs are energized through said second current supply path with the maximum source voltage.

5. A system according to claim 1, further comprising means for maintaining said second path to continue a stable preheating current during a warm-up period of even after the start of the engine.

6. A system according to claim 5, wherein said maintaining means includes temperature detecting means for detecting the engine temperature, and discriminating means for for discriminating the detected temperature to prevent the supply of current from said power supply to said glow plugs when the detected temperature exceeds a predetermined value and to allow the supply of current through said second path to said glow plugs when the detected temperature is lower than said predetermined value.

7. An engine preheating control system according to claim 1, wherein said switching means includes a first relay means for forming said first current supply path and a second relay means for forming said second current path for supplying current to said glow plugs without said first relay means but through said stable preheating resistor.

8. An engine preheating control system comprising:

a power supply;

engine preheating glow plugs each including a heat radiator having a predetermined temperature coefficient of resistance;

a stable preheating resistor for reducing the current applied to said glow plugs;

switching means including at least two switch elements for forming a first path for supplying current to said glow plugs without the agency of said stable preheating resistor and a second path for supplying current to said glow plugs through said stable preheating resistor, said switching means adapted to switch to selectively form said first and second paths;

a detecting resistor inserted in a current supply path to said glow plugs and producing a voltage drop proportional to the current through said glow plugs;

a temperature detector for producing an electric signal according to the engine temperature;

start detection means for producing an electric signal corresponding to the engine operating condition;

and control means adapted to be rendered operative when supplied with power from said power supply at the time of the closure of an engine key switch and automatically controlling the switching of said first and second current supply paths in response to the voltage drop produced in said detecting resistor and electric signals from said temperature detector and start detection means;

said control means including:

first means for producing a first control signal to supply current to said glow plugs through said first path to raise the temperature of said plugs up to a first predetermined value, thereafter to supply current to said glow plugs through said second path to lower the temperature of said plugs from the first predetermined value to a second predetermined value and thereafter to supply current to said glow plugs again through said first path;

wherein said control means further includes a fourth means having a second comparator circuit for producing a fourth control signal through the comparison of the temperature detection output of said temperature detector and a preset value, said third means has a timer circuit responding to said start detection means and produces said third control signal immediately before or immediately after the start of the engine, and said amplifying means controls the switching operation of said switching means in response to said first to fourth control signals.

9. An engine preheating control system according to claim 8, which further comprises a fifth means comprising a timer circuit for producing immediately after the closure of the engine key switch a fifth control signal in response to said fourth control signal, said fifth control signal being continued for a long period of time when the temperature detector represents a high temperature and continuing a short period of time when said temperature detection output represents a low temperature, and a display means operated in response to said fifth control signal.

10. An engine preheating control system according to claim 9, wherein during said long period of time sufficient heat generation from said glow plugs is caused to permit cranking.

11. An engine preheating control system according to claim 9, wherein said amplifying means has a power amplifier transistor for switching said second current supply path irrespective of the engine starting operation in response to said fourth control signal when the temperature detection output of said temperature detector represents said high temperature.

12. An engine preheating control system according to claim 8, wherein said amplifying means has a power amplifier transistor for switching said second current supply path irrespective of the engine starting operation in response to said fourth control signal when the temperature detection output of said temperature detector represents said high temperature.

13. An engine preheating control system comprising:

a power supply;

engine preheating glow plugs each including a heat radiator having a predetermined temperature coefficient of resistance;

a stable preheating resistor for reducing the current applied to said glow plugs;

switching means including at least two switch elements for forming a first path for supplying current to said glow plugs without the agency of said stable preheating resistor and a second path for supplying current to said glow plugs through said stable preheating resistor, said switching means adapted to switch to selectively form said first and second paths;

a detecting resistor inserted in a current supply path to said glow plugs and producing a voltage drop proportional to the current through said glow plugs;

a temperature detector for producing an electric signal according to the engine temperature;

start detection means for producing an electric signal corresponding to the engine operating condition;

and control means adapted to be rendered operative when supplied with power from said power supply at the time of the closure of an engine key switch and automatically controlling the switching of said first and second current supply paths in response to the voltage drop produced in said detecting resistor and electric signals from said temperature detector and start detection means;

said control means including:

first means for producing a first control signal to supply current to said glow plugs through said first path to raise the temperature of said plugs up to a first predetermined value, thereafter to supply current to said glow plugs through said second path to lower the temperature of said plugs from the first predetermined value to a second predetermined value and thereafter to supply current to said glow plugs again through said first path;

wherein said control means has a fourth means for producing a fourth control signal through the comparison of the temperature detection output of said temperature detector with a reference value, said third means has a timer circuit for producing a third control signal in response to the closure of said engine key switch, and said control means has a fifth means for producing immediately after the closure of said engine key switch a fifth control signal in response to said fourth control signal, said fifth control signal continuing a short period of time when the temperature detection output of said temperature detector represents a high temperature and continuing a long period of time when said temperature detection output represents a low temperature, and said control means has a display means operated in response to said fifth control signal.

* * * * *